US006265818B1

(12) United States Patent
Adamski et al.

(10) Patent No.: US 6,265,818 B1
(45) Date of Patent: Jul. 24, 2001

(54) STIFFENED SUPPORT SPRINGS AND CRT INCORPORATING SAME

(75) Inventors: Alfred Adamski; Brian T. Doepker, both of Ann Arbor, MI (US)

(73) Assignee: Philips Electronics North America Corporation, New York, NY (US)

( * ) Notice: Subject to any disclaimer, the term of this patent is extended or adjusted under 35 U.S.C. 154(b) by 0 days.

(21) Appl. No.: 08/300,684

(22) Filed: Sep. 2, 1994

(51) Int. Cl.[7] ..... H01J 29/80
(52) U.S. Cl. ..... 313/402; 313/407; 313/408
(58) Field of Search ..... 313/402, 404, 313/406, 407

(56) References Cited

U.S. PATENT DOCUMENTS

| | | | | |
|---|---|---|---|---|
| 3,986,072 | | 10/1976 | Adamski | 313/404 |
| 4,028,580 | * | 6/1977 | Dougherty | 313/406 |
| 4,335,329 | * | 6/1982 | Fukuzawa et al. | 313/406 |
| 4,367,430 | * | 1/1983 | Matsushita et al. | 313/402 |
| 4,663,561 | | 5/1987 | Brunn | 313/406 |
| 4,670,687 | | 6/1987 | Gijrath et al. | 313/404 |

FOREIGN PATENT DOCUMENTS

| | | |
|---|---|---|
| 56-97944 | 8/1981 | (JP) . |
| 56-97945 | 8/1981 | (JP) . |
| 58-16442 | 1/1983 | (JP) . |

* cited by examiner

*Primary Examiner*—Nimeshkumar D. Patel
*Assistant Examiner*—Joseph Williams

(57) ABSTRACT

Resistance to deformation of a support spring for the mask-frame assembly of a cathode ray tube is improved by adding strengthening ribs running longitudinally along the edges of the body and partially into the base of the spring.

2 Claims, 6 Drawing Sheets

STIFFENED SUPPORT SPRINGS AND CRT INCORPORATING SAME

BACKGROUND OF THE INVENTION

This invention relates to cathode ray tubes (CRTs) for color television, and more particularly relates to the bimetal springs which support the aperture mask-frame assembly in the face panel portion of the glass envelope of the CRT.

Cathode ray tubes (CRTs) used in color television commonly employ an aperture mask suspended a short distance behind the face panel portion of the tube's glass envelope. The function of the aperture mask is to direct the electron beams from the electron guns in the neck portion of the envelope to the proper phosphor elements of the luminescent display screen, which is located on the inner surface of the face panel. The suspension arrangement must be capable of maintaining the mask in the proper position during the tube's operation, in order to prevent mis-registration of the apertures and the phosphor elements. Such mis-registration could result in the electron beams landing on the wrong phosphor elements, causing degradation of the color purity of the display image.

In one design, the mask, which is a relatively thin sheet of metal containing a large number of small apertures, is supported by a heavier gage metal frame, and the frame is supported in the panel by three or four bimetal springs mounted to the sides of the frame. These springs are designed to deflect upon heating during the tube's initial warm-up period in order to maintain registration between the mask and screen.

One end of each support spring is welded to the mask frame, while the other end defines an aperture which engages a mounting stud embedded in the side wall or skirt of the glass face panel. Between the ends, the spring is bent in order to lift the main portion of the spring out of the plane of the welded end. The angle of the bend determines the spring load required to deflect the spring to allow insertion of the mask-frame assembly into the panel.

Because registration between the mask apertures and the phosphor elements on the luminescent screen is so critical, the mask is used in the manufacture of the screen. In order to insure registration, the photosensitive layers containing the different color phosphors are exposed through the mask. Because there are three separate exposures for three separate colors (red, blue, green), the mask-panel assembly must be inserted and removed from the panel several times before final assembly.

After final insertion of the mask-frame assembly into the panel to form the panel-mask assembly (PMA), it is critical to the operation of the tube that the registration between the apertures and the phosphor elements be maintained. If the picture tube is mis-handled, for example, dropped or jarred during packing, shipping or storing, the mechanical forces on the tube will be transmitted to the support springs through the panel via the studs. Since the springs are cantilevered, they can experience very high torsional loading in the area of the bend radius. If the torsional loading causes permanent deformation of one or more of the springs, the tube must be rejected.

Various means have been suggested to improve the resistance of such support springs to mechanical shock. In JP-A 56-97944, the main portion of the spring is constituted by two slightly non-parallel legs; in JP-A 56-97945, the main portion of the spring is constituted by two legs, one of which has an arc shaped curve; other patents, such as U.S. Pat. Nos. 3,986,072; 4,663,561; and 4,670,687, describe mask assemblies which do not have rigid support frames and which have corner mounting systems employing leaf springs having lower spring rates than the side-mounted springs employed with rigid frames.

OBJECTS AND SUMMARY OF THE INVENTION

It is an object of the invention to provide an improved support spring for side-mounted attachment to the frame of a CRT mask-frame assembly.

It is another object of the invention to provide such a support spring having improved resistance to permanent deformation.

It is another object of the invention to provide such a support spring which is readily manufacturable.

It is another object of the invention to provide a CRT incorporating one or more improved support springs.

In accordance with one aspect of the invention, there is provided a support spring for a CRT comprising at one end a base portion for attachment to a side of a support frame for an aperture mask, an apertured portion at the other end for engagement with a mounting stud in the side wall of a face panel, and a main portion connecting the base and apertured portions, the base portion lying in a first plane, and the main and apertured portions lying in a second plane which intersects the first plane at an angle referred to herein as the bend angle, characterized in that the spring has two raised ribs or embossments extending longitudinally in at least part of the main body portion.

In accordance with a preferred embodiment of the invention, the ribs extend partially into the base portion. The dimensions of the ribs are chosen to achieve a torsional stiffness sufficient to resist permanent deformation from mechanical shocks due to mis-handling, while maintaining sufficient resilience to protect the aperture mask from deformation.

In accordance with another aspect of the invention, there is provided a CRT incorporating one or more of the improved support springs of the invention. The base portions of the springs are attached to the sides of the rigid frame supporting the aperture mask of the CRT, preferably by welding, while the apertured portions engage mounting studs embedded in and protruding from the side wall or skirt of the face panel of the CRT.

DESCRIPTION OF THE PREFERRED EMBODIMENTS

Figure 1:
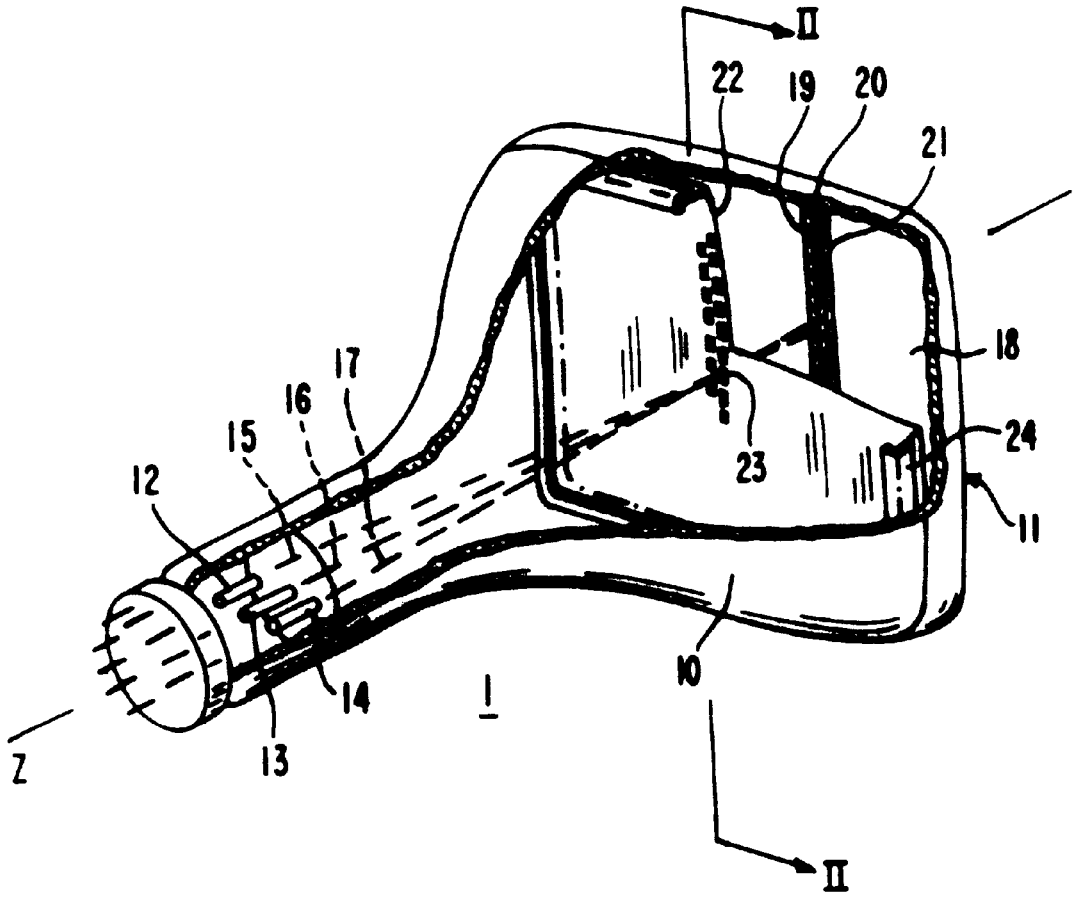
FIG. 1 is a perspective view, partially cut away, of a color cathode ray tube of the prior art including an aperture mask supported by a rigid frame.

Referring now to FIG. 1, there is shown a perspective view, partly cut away, of a color CRT of the prior art employing an aperture mask and a rigid support frame. CRT 1 has a glass envelope which is made up of funnel portion 10 and face panel portion 11. Located in the rear or neck of funnel portion 10 are three in-line electron guns 12, 13 and 14, which generate electron beams 15, 16 and 17. These beams are directed toward luminescent phosphor screen 18, disposed on the inside of face panel 11. Screen 18 is composed of triplets of individual phosphor elements, one of which is shown, in the form of vertical stripes 19, 20 and 21.

Figure 2:
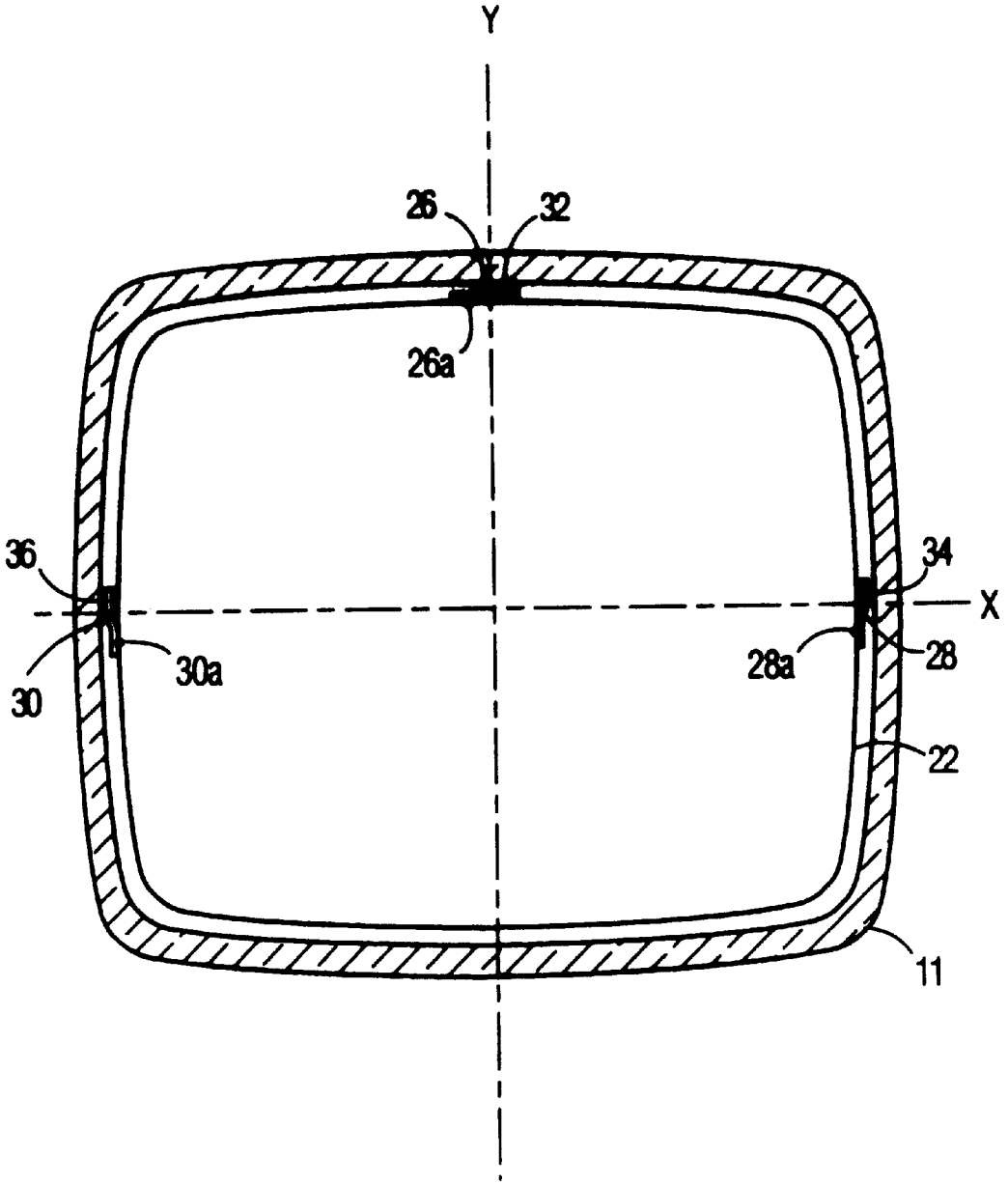
FIG. 2 is a front section view of the tube of FIG. 1, taken along the line II—II, showing support springs between the frame and the face panel side wall of the tube.

Situated a short distance in front of screen 18 is aperture mask 22, a thin sheet of metal with a very large number of apertures 23 located to direct the electron beams to the proper phosphor elements on the screen. Mask 22 is supported by rigid frame 24, which is in turn supported by support springs 26, 28 and 30 (FIG. 2) attached at one end to the frame by welds 26*a*, 28*a* and 30*a*. The other end of the springs are apertured, and engage metal studs 32, 34 and 36 imbedded in the side wall or skirt of panel 11. In this embodiment, which is typical of the prior art, there are three springs, two located near the X axis and one near the Y axis of the tube.

Figure 3:
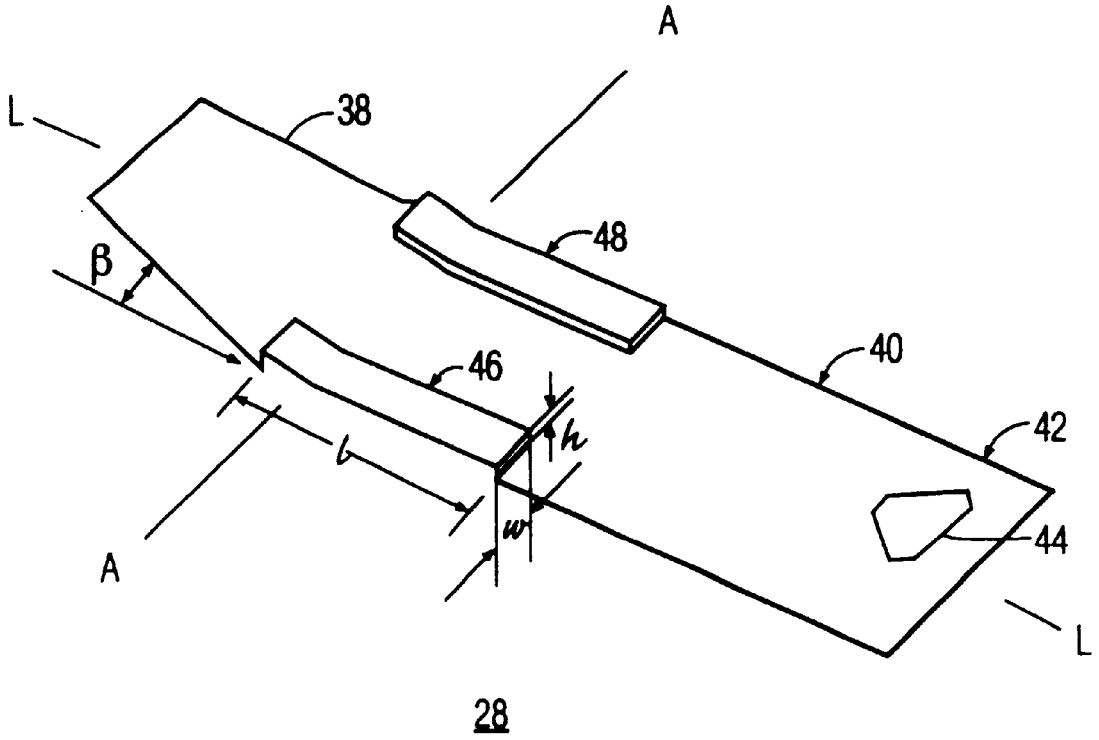
FIG. 3 is a perspective view of one embodiment of a support spring of the invention having stiffening ribs.

FIG. 3 shows one embodiment of an improved support spring 28 of the invention which is a strip-shaped member having a base portion 38, a main body portion 40 and an apertured portion 42, having aperture 44, adapted for engagement with a metal support stud in the skirt of the face panel. In accordance with the teachings of the invention, the spring has raised ribs 46 and 48 extending along the edges of the strip in the direction of longitudinal axis L.

The spring is readily fabricated from a coil of spring material, by first stamping, using a die which forms the aperture and the ribs, then bending the spring at axis A to lift the main and apertured portions out of the plane of the base portion, and finally cutting the spring from the coil. When the base portion is welded to the frame, the remainder of the spring will extend away from the frame toward the panel skirt. After bending, the base and remaining portions of the spring lie in different planes, which planes intersect at an angle of 180 degrees minus the bend angle beta.

In the embodiment shown, the ribs lie mainly in the body portion, but also extend partially into the base portion. In order to illustrate the advantages of this spring design, a series of stress plots were generated by Algor modeling for a prior art spring and a spring according to the invention.

Figure 4:
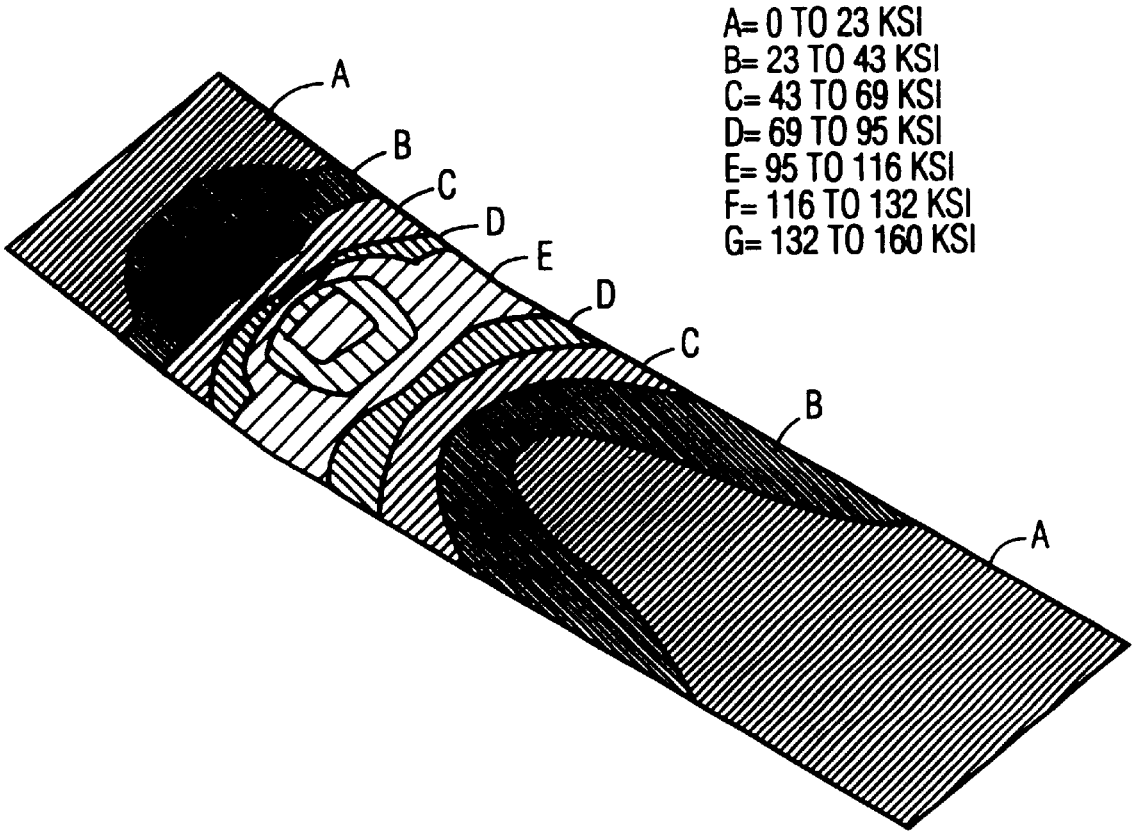
FIGS. 4 and 5 are perspective views of a support spring of the prior art and a spring of the invention, respectively, showing stress distributions for various torsional loads.

FIG. 4 is a stress plot of the prior art support spring fabricated from a composite spring material of Invar (36 wt. percent Ni, remainder Fe) and an alloy of 22 wt. percent Ni, 3 wt. percent Cr, remainder Fe; and having the following dimensions (where "active length" is defined as the distance between the aperture and the bend):

active length: 1.797 inches
overall width: 0.600 inch
thickness: 0.035 inch
base length: 0.750 inches
bend angle: 10°0' and placed under a torsional load of about 80 pounds, applied at the aperture in a plane parallel to the tube's "Z" axis. This load is typical for a standard face drop test, in which a tube is subjected to a 35G, 12 m sec, ½ sine wave impact. As may be seen, the stress level in the area of the bend is 113 Ksi, which is above the elastic limit of the spring material.

Figure 5:
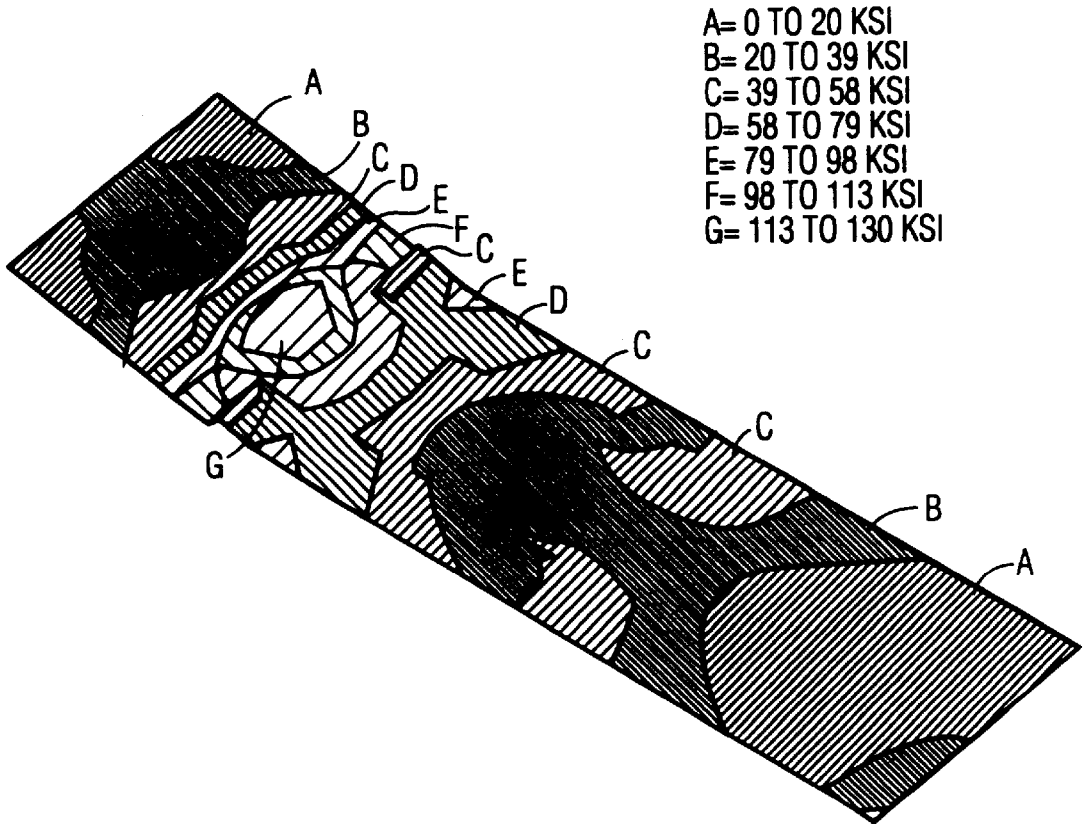

FIG. 5 is a stress plot of a spring of the invention, having the same overall dimensions and bend angle as the spring of FIG. 4, and in addition having two strengthening ribs with the following dimensions:

rib length: 0.900 inches
rib width: 0.150 inches
rib height: 0.025 inches

As can be seen, the high stresses have been reduced at the spring bend line.

Figure 7:
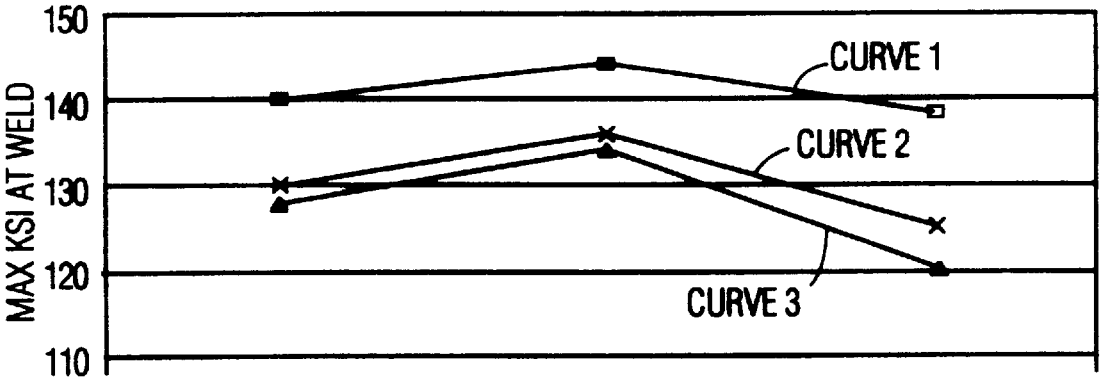
FIG. 7 is a graph similar to that of FIG. 6 for stress at the spring weld.
Figure 6:
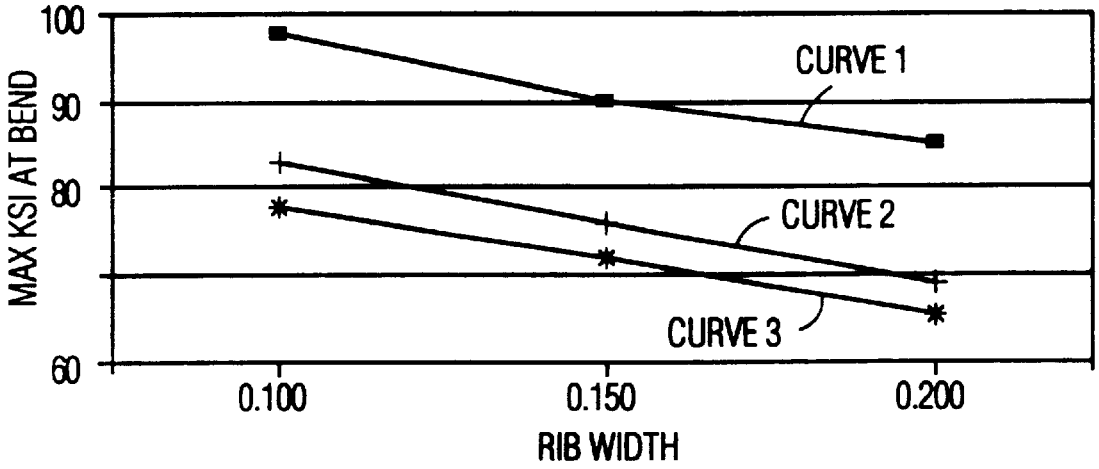
FIG. 6 is a graph of maximum stress at the spring bend in Ksi versus rib width for different rib heights.

FIGS. 6 and 7 illustrate graphically data for maximum stresses at the spring bend line and the first weld (weld nearest the bend) at the spring base for various rib heights and widths for a load of 80 pounds applied at the spring aperture in the direction of the tube's "Z" axis. The invariant spring dimensions were as follows:

active length: 1.800 inches
overall width: 0.600 inches
thickness: 0.035 inches
base length: 0.750 inches
bend angle: 10°0'
rib length: 0.400 inches FIG. 6 plots the maximum stress at the bend versus rib width ranging from 0.100 to 0.200 inches, for three different rib heights: 0.015 inch (curve 1); 0.025 inch (curve 2); and 0.030 inch (curve 3). As may be seen, stresses at the bend decrease with increasing rib width as well as rib height. However, as the height of the rib increases to a point equal to the thickness of the spring material, problems such as increased spring back (tendency of the spring material to remember its original position), cracking and tool life make dimensional control difficult, which affects spring quality.

FIG. 7 plots graphically the stress at the first weld (weld closest to the bend) in the base for the same rib heights and widths as in FIG. 6. Stresses at the weld also decrease with increasing rib height. However, as rib width increases from 0.100 to 0.200 inches, stresses first increase slightly before they decrease.

Based on these curves and manufacturing concerns, a rib height of 0.025 inches and rib width of 0.150 inches appear to be optimal. This dimensional combination results in a maximum stress at the bend of about 76 Ksi and at the first weld of about 135 Ksi.

For comparison, a model was developed for the prior art spring without ribs under the same 80 pound load, under which the maximum calculated stress at the bend and at the first weld were 113 and 145 Ksi, respectively.

The invention has been described in terms of a limited number of embodiments. Other embodiments and variations of embodiments will become apparent to those skilled in the art from the above description, and are intended to be encompassed within the scope of the appended claims.

What We claim as my invention is:

1. A support spring for an aperture mask-frame assembly in a cathode ray tube, the spring being an elongated member of flat spring material comprising a base portion lying in a first plane and the body and apertured portions lying in a second plane, the first and second planes intersecting to form an angle, characterized in that two raised spaced apart ribs of spring material extend longitudinally along at least a portion of the body portion of the spring, in which the ribs extend at least partially into the base portion of the spring.

2. A cathode ray tube comprising: an envelope including a funnel portion and a face panel portion; at least one electron gun in the rear of the funnel portion; a luminescent phosphor screen on the inside of the face panel portion; and a mask-frame assembly positioned a short distance behind the screen, the mask-frame assembly comprising a thin metal sheet having a large number of apertures and a rigid support frame and at least two supporting springs, each spring having a base portion attached to a side wall of the panel portion, and an apertured portion engaging a support stud embedded in and protruding from the panel portion side wall, characterized in that at least one support spring has two spaced apart raised ribs extending longitudinally along at least part of the body portion, in which the ribs extend at least partially into the base portion of the spring.

* * * * *